United States Patent [19]

Whiteley et al.

[11] Patent Number: 4,702,068

[45] Date of Patent: Oct. 27, 1987

[54] FRICTION SPINNING ROLLER

[75] Inventors: John Whiteley, Clitheroe, England; Fred A. Shepherd, Killearn, Scotland

[73] Assignee: Hollingsworth U.K., Ltd., Accrington, England

[21] Appl. No.: 912,031

[22] Filed: Sep. 25, 1986

[51] Int. Cl.[4] ..... D01H 7/882

[52] U.S. Cl. ..... 57/401

[58] Field of Search ..... 57/400, 401; 384/320, 384/476, DIG. 900

[56] References Cited

U.S. PATENT DOCUMENTS

| | | | |
|---|---|---|---|
| 3,311,293 | 3/1967 | Moffatt | 384/320 X |
| 4,502,272 | 3/1985 | Fuchs | 57/401 |
| 4,537,022 | 8/1985 | Stahlecker | 57/401 |
| 4,541,232 | 9/1985 | Raasch | 57/401 X |
| 4,541,233 | 9/1985 | Raasch et al. | 57/22 X |
| 4,590,756 | 5/1986 | Stahlecker | 57/401 |

*Primary Examiner*—Donald Watkins

*Attorney, Agent, or Firm*—Cort Flint

[57] ABSTRACT

The perforated roller of a friction spinning unit includes an outer sleeve having vent openings at one end to provide an air leakage path which by-passes the adjacent bearing of the sleeve, and further by-passing vent passages radially outwardly of the bearing at the opposite end of the sleeve.

14 Claims, 3 Drawing Figures

FRICTION SPINNING ROLLER

FIELD OF THE INVENTION

The present invention relates to a roller for a friction spinning unit, and in particular to the type of roller which defines a friction surface of the unit and is of perforated form to allow suction applied within the roller to attract fibres onto the roller surface at least at the nip where incident fibres become rolled up to form a twisting bundle for axial withdrawal in the form of yarn.

PRIOR ART

Friction spinning units are known which comprise perforated rollers to allow suction to be applied at the nip for generating yarn from incident discrete fibres. For example, one form of such friction spinning unit is disclosed in GB-A-2,042,599 where one of the two rollers is perforated and the other is imperforate. Other forms of friction spinning apparatus have both of the closely spaced friction spinning rollers perforated, as disclosed in GB-A-1,574,531.

In any practical friction spinning unit it is important that the clearance between the two rollers be accurately set and remain accurately set during prolonged use of the friction spinning unit. Thus the clearances between moving parts of the perforated rollers can be very fine, but nevertheless there must in practice be some clearance provided between the inner baffle which traditionally defines the suction slot at the nip, and the outer at least partly perforated sleeve which rotates around that stationary baffle at high speed. Although in theory the fit between the perforated outer sleeve and the inner baffle should be virtually sealed, there will be some air leakage round the slot and this will be capable of dispersing to some extent the suction effect which ought to be concentrated at the slot.

Furthermore, it is known, from EP-A-O 125 341 to provide an inner baffle which is rotatable relative to the above-mentioned baffle which defines the suction slot, this inner baffle defining a for example parallelogram-shaped inner slot to co-operate with the generally rectilinear slot of the outer baffle for controlling the progressive extinguishing of suction along the generally rectilinear slot upon shut-down and the progressive re-application of suction along that slot upon piecing. The fact that this inner baffle needs to be controlled from outside gives rise to further possible air leakage paths.

OBJECT OF THE INVENTION

It is an object of the present invention to reduce as much as possible the tendency for any fly or spinnable short fibre to enter these fine clerances and to give rise to additional drag and heat generating friction within the clearances between relatively movable elements of the friction spinning unit.

SUMMARY OF THE INVENTION

According to the invention we provide a perforated friction spinning roller having at least one vent located in the surface of the friction spinning roller between the main perforated surface portion and an end bearing, for providing an air leakage path which is deliberately of lower resistance than any air leakage path through the bearing itself.

Preferably such vents are provided at both ends of the roller.

The effect of having such leakage paths is to ensure that any air flow inwardly from the exterior of the perforated roller induced by the dissipated suction effect by-passes the bearing and thus there is no net inflow of air through the bearing, either causing possible drying out of the grease of the bearing, or carrying fly and dust through the bearing and contaminating the bearing.

The additional leakage path of low resistance may be defined in an end surface of the roller, and/or in the cylindrical surface of the roller.

Preferably a labyrinth seal may be created at or near the said end bearing in order to decrease the air leakage path through the bearing.

BRIEF DESCRIPTION OF THE DRAWINGS

In order that the present invention may more readily be understood the following description is given, merely by way of example, with reference to the accompanying drawing in which:

FIG. 3 is a view similar to FIG. 1 but showing a modified form of the roller.

DESCRIPTION OF THE PREFERRED EMBODIMENTS

Figure 1:
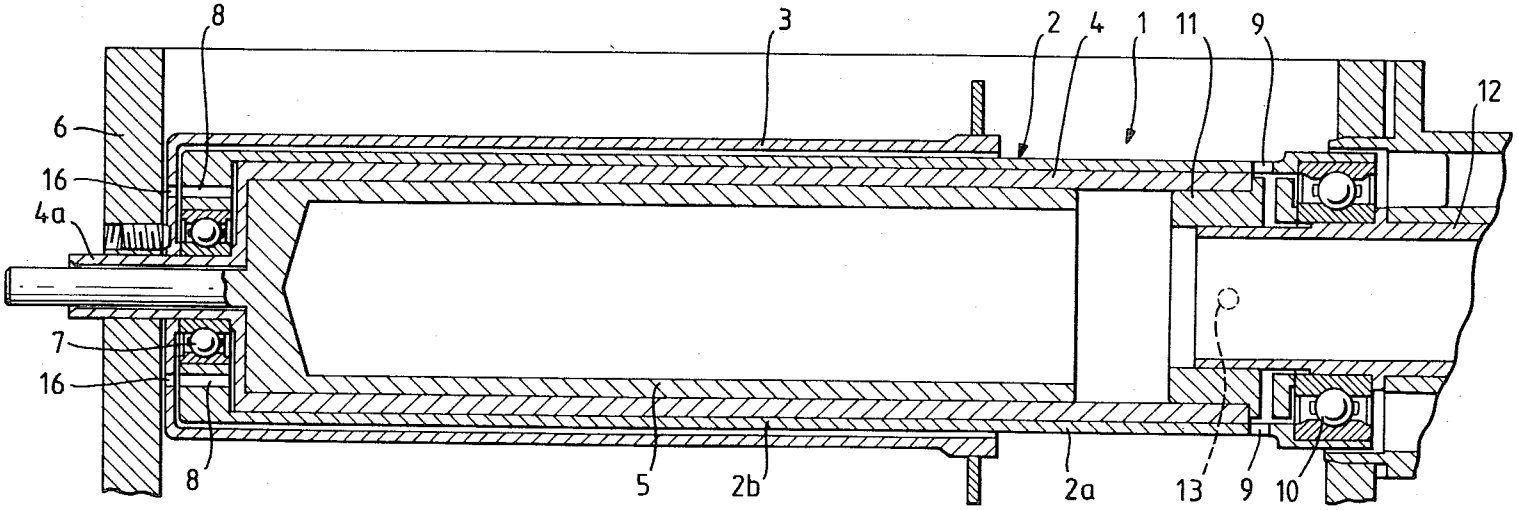
FIG. 1 shows a longitudinal sectional view through a perforated friction spinning roller incorporating the present invention.

Referring now to FIG. 1, there can be seen a perforated roller 1 comprising an at least partly foraminous outer cylindrical body 2 whose outer surface is optio nally surrounded by a shroud 3 over the part of the circumference of the body 2 away from the friction spinning nip. In practice the area of the body 2 which in this case is surrounded by the optional shroud 3 is finely perforated so as to allow suction applied through a slot defined by a baffle 4 within the cylindrical body 2 to be communicated along a yarn formation region at the nip between the roller 1 and an adjacent roller (not shown in FIG. 1) which may be of imperforate or perforated form, as desired.

The region 2*a* of the cylindrical body 2 is imperforate and over this part of the surface of the roller a much more gentle handling of the fibres at the fragile tip of the bundle of fibres in the forming yarn is effected.

Within the baffle 4, defining the generally rectilinear suction slot at the nip, is an inner baffle 5 having a slot with a particular functional form such as the parallelogram disclosed in EP-A-O 125 341. This slot is used for controlling the progressive extinguishing of suction along the rectilinear slot upon shut-down and the progressive re-application of suction along the slot upon piecing, simply by rotating the inner baffle 5. For simplicity, the slot in the baffle 5 and the rectilinear slot in the outer baffle 4 are omitted from the drawing.

Because of the rotation of the mainly foraminous cylindrical outer body 2 relative to the outer baffle 4 in which the suction slot (not shown) is provided, there will be a slight clearance which will allow dissipation of the suction effect from the left hand end of that slot and could result in a generally rightward flow of air in through the left hand end of the perforated roller assembly 1. Furthermore, because it is possible for the outer baffle 4 to be rotatable as disclosed in EP-A-0181105 (in order to set the level of its rectilinear slot relative to the nip for tuning the friction spinning unit to particular materials), there is also the possibility of an air leakage path between the stub 4*a* of the baffle 4 and the wall 6 of the friction spinning chamber. Both of these air leakage paths would normally include the bearing 7 at the left hand end of the cylindrical body 2, but to avoid such an air flow through the bearing 7 there is a set of vent bores, for example four vent bores 8, which allow air to pass into the above-mentioned clearance between the outer baffle 4 and the surrounding and rapidly rotating cylindrical body 2 but without drawing that air through the bearing 7 and consequently risking drying out of the grease in the bearing and possible contamination of the bearing with dust.

To assist with this "bearing by-passing" venting action, the end wall of the shroud 3 also has a pair of vent bores 16 at the same radial spacing from the axis of rotation of roller 1 as the vent bores 8 in the flange portion of the cylindrical body 2.

Likewise, at the opposite end of the perforated roller assembly 1 are two vent holes 9 in the outer cylindrical body 2, immediately adjacent the associated bearing 10 so as to allow radially inward flow of air into (a) the clearance between the outer baffle 4 and the surrounding cylindrical body 2 and (b) the inner and/or outer clearances around a rotation-permitting bush 11 supporting the right hand end of the outer baffle 4 rotatably with respect to a stationary inner suction pipe 12.

A further vent hole 13 in the cylindrical body 2 lies directly outside the bush 11 and is only effective to allow airflow to the clearance between the baffle 4 and the cylindrical body 2.

Although there is no limitation to be implied by dimensions given in this application, we can indicate by way of example that in a preferred embodiment the vent holes 9 and 13 have a diameter which is at least eight times greater than the diameter of the perforations making up the perforated region 2*b* of the cylindrical body 2 surrounded by the shroud 3.

The vent bores 8 may have diameters of the order of four times the size of the perforations of region 2*b*.

It will of course be appreciated that the number of vent openings 8, 9 and 13, as well as their distribution and their cross-sectional areas, will be chosen to give just sufficient air flow to guard against drying out of the bearing grease in bearings 7 and 10 and to prevent build-up of dust and fly in the fine working clearances of the machine, but will not be so great that there is any appreciable loss of efficiency of the technological air flow generated by the suction prevailing within the suction pipe 12.

In the case of the holes 9 and 13 which are the more likely ones to pass spinnable fibre as well as air, there is a self-cleaning action by virtue of the centrifugal forces on any fibres stagnating in the holes 9 and 13. Since the air passing through the vent bores 8 at the left hand end of the perforated cylindrical body assembly 1 will be in the main free of spinnable fibre, no such cleaning action is necessary and axially extending bores are adequate.

If desired, the hole 13 may be used to facilitate setting of the slot level with the aid of a dimple in the exterior of the baffle 4, accessible by a tool which fits in the hole 13 in the outer cylindrical body 2, thus enabling the position of the dimple, and hence of the setting of the slot in the baffle 4 to be determined from outside the cylindrical body 2.

A further embodiment of the friction spinning roller shown in FIG. 1 is illustrated in FIG. 3 where many of the components are identical to those shown in FIG. 1 and are, in FIG. 3, increased by 100. Because these identical components have been described earlier no separate description will follow now and the description of FIG. 3 will instead concentrate on those elements which vary from the FIG. 1 embodiment.

At the lefthand end of the roller the construction is different because there is no longer a shroud surrounding the cylindrical body 102, and the end wall of the cylindrical body 102 is in this case defined by a plug member 120 having an outer flange portion 121 which fits the interior of the cylindrical body 102 and the plug member 120 furthermore defines a central opening to receive the drive sleeve 104*a* of the outer baffle 104 and also defines an annular recess to retain the bearing 107 rotatably supporting the plug member 120 relative to the sleeve 104*a*.

In use of the roller of FIG. 3 there will be a tendency for air to flow rightwardly along the interior of the perforated portion 102*b* of the cylindrical body 102 and in order to reduce such airflow tendency the extreme left hand end of the baffle 104 is provided with peripheral grooves 122 which act as a labyrinth seal.

As a further sealing member at the lefthand end there is a plate 123 having a peripheral groove 124 at its outer circumference, defining together with the interior of the flange portion 121 of the plug member 120 a further labyrinth seal.

The vent openings to by-pass the bearing 107 at the lefthand end of the roller 101 shown in FIG. 3 include a set of vent holes, in this case 45 such holes 125 in the plug member 120, providing a direct air leakage path between the two labyrinth seals 122 and 124.

As an additional means of ensuring that air by-passes the bearing 107, the plug member 120 furthermore includes a plurality of additional vent bores 126, in this case 12 of such bores, again radially outwardly of the bearing so as to by-pass the bearing 107*a*.

The lefthand end of the roller 101 is thus protected by the vent bores 126, which provide a direct leakage path for any air managing to pass the labyrinth seal 124 to enter the disc-shaped gap between the end plate 123 and the plug member 120 without passing through the hole 125, and the holes 125 themselves provide a more direct air leakage path from the labyrinth seal region 124 to the further labyrinth seal region 122.

It will thus be appreciated that the embodiment of FIG. 3 provides two air leakage paths in parallel and arranged such that each includes at least one common labyrinth seal to cut down the total leakage flow of air along those leakage paths. Thus the configuration can be considered as a parallel impedence network where the impedence of the airflow paths 125 and 126 is greater than the impedence through the bearing 107, and each of these three branches is in series with at least one high impedence defined by the labyrinth seal 122 and 124. The end result is to ensure that there is virtually zero flow through the bearing 107, thereby minimizing the affect of dust and fibre carried in any leakage air stream and minimizing the tendency for the bearing grease to dry out.

At the righthand end of the roller 101 a similar "series-parallel" network is provided in that there are air vent holes 127 which directly by-pass the bearing 110 and both these and the bearing are in series with an extensive labyrinth seal region 128 formed at the interface between the interior of the imperforate region 102*a* of the cylindrical body 102 and the outer surface of the baffle 104.

In the embodiment of FIG. 3, the bush 111 is sealed to the relatively rotatable outer baffle 104 and the inner stationary suction pipe 112 by virtue of outer and inner O-ring seals 129 and 130, respectively.

Figure 2:
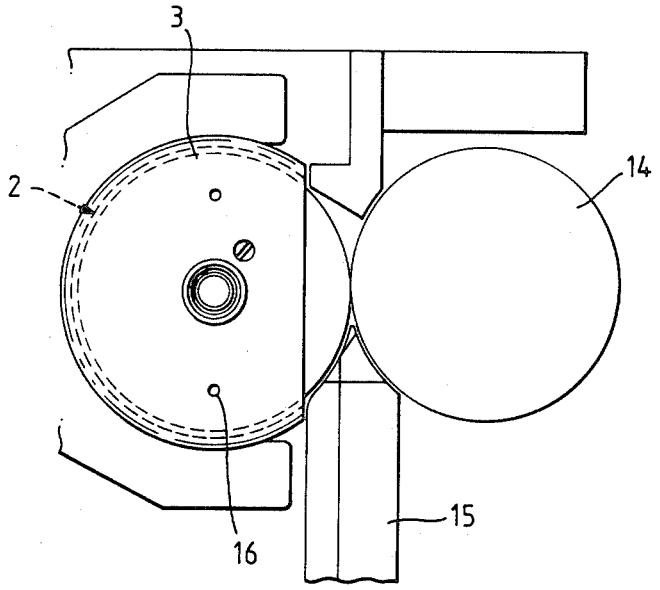
FIG. 2 shows an end view of the friction spinning roller of FIG. 1 and adjacent parts of the friction spinning unit incorporating it.

It will of course be understood that there is no necessity for both ends of the perforated roller assembly 1 to be vented in this way, although it is envisaged that the end remote from the yarn doffing tube (i.e. the right hand end in FIG. 1) will be vented. For information, we can indicate that in a preferred embodiment of friction spinning unit in accordance with the present invention the fibre feed duct (shown as 15 in FIG. 2) guides individual fibres in an upward and rightward direction (as viewed in FIG. 1) onto the yarn formation nip, and the yarn doffing tube is formed in the chamber wall 6 at the left hand end of the spinning chamber, centrally with respect to the axes of rotation of the perforated roller 1 (see FIGS. 1 and 2) and the adjacent imperforate roller 2 (FIG. 2 above)

Where both of the rollers 1 and 14 are perforated they may both have such vents.

We claim:

1. A friction spinning roller comprising (a) perforation means defining a perforated cylindrical surface;

(b) suction appling means within said perforation means;

(c) air transmitting bearing means rotatably supporting said peroforation means and defining a first air leakage path from the exterior of said perforation means to said suction applying means; and (d) means defining at least one vent communicating the interior of said perforation means with the exterior thereof adjacent said air-transmitting bearing means, and for providing a second air leakage path which is deliberately of lower resistance than said first air leakage path through the air-transmitting bearing means, said air-transmitting bearing means being outside said second air leakage path whereby said first and second air leakage paths are in parallel with one another.

2. A friction spinning roller according to claim 1, wherein said perforation means comprises an at least partly foraminous rotatable outer sleeve, and wherein said suction applying means are in the form of a baffle within said at least partly foraminous rotatable outer sleeve, said at least partly foraminous rotatable outer sleeve rotatably surrounding said baffle; and wherein said at least one vent is located in said at least partly foraminous rotatable outer sleeve.

3. A friction spinning roller according to claim 1, including common labyrinth seal means in series with said parallel-arranged first and second air leakage paths to minimize total air leakage along the first and second air leakage paths.

4. A friction spinning roller according to claim 3, wherein said perforation means comprises an at least partly foraminous rotatable outer sleeve; wherein said suction applying means are in the form of a baffle disposed within said outer sleeve, said at least partly foraminous rotatable outer sleeve rotatably surrounding said baffle; wherein said at least one vent is located in said at least partly foraminous rotatable outer sleeve; and wherein said common labyrinth seal includes the radially inner surface of said at least partly foraminous rotatable outer sleeve.

5. A friction spinning roller according to claim 3, wherein said rotatable outer sleeve of the roller has a cylindrical portion surrounding said baffle, and said at least one vent is formed in said cylindrical portion.

6. A friction spinning roller according to claim 2, wherein said outer sleeve has a radially extending end wall, and said at least one said vent extends axially through said radially extending end wall of the outer sleeve.

7. A friction spinning roller according to claim 2, wherein the outer sleeve has a perforated major portion communicating internal suction with the friction spinning nip, and has an end portion of imperforate form, and wherein said at least one vent is formed in said imperforate wall portion adjacent said bearing means and opens into the interior of said sleeve closer to the said perforated region than is the bearing means.

8. A friction spinning roller according to claim 3, including a respective said common labyrinth seal at each end of the at least partly foraminous outer sleeve, and a respective said at least one vent by-passing the respective bearing means at each end of the roller.

9. A friction spinning roller comprising (a) an at least partly foraminous rotatable outer sleeve of said roller defining a perforated cylindrical surface;

(b) a baffle within said outer sleeve said outer sleeve rotatably surrounding said baffle;

(c) means communicating said baffle with a source of suction;

(d) air-transmitting bearing means rotatably supporting said at least partly foraminous rotatable outer sleeve, said air-transmitting bearing means defining a first air leakage path between the exterior of said friction spinning roller and said source of suction;

(e) means defining at least one vent communicating the interior of said at least partly foraminous rotatable outer sleeve with the exterior thereof adjacent said air-transmitting bearing means, for providing a second air leakage path which is deliberately of lower resistance than said first air leakage path through the air-transmitting bearing means itself.

10. A friction spinning roller according to claim 9, wherein said first and second air leakage paths are in parallel, and including common labyrinth seal means in series with said parallel-arranged first and second air leakage paths to minimize total air leakage along the first and second air leakage paths.

11. A friction spinning roller according to claim 10, wherein said at least partly foraminous rotatable outer sleeve of the roller has a cylindrical portion surrounding said baffle, and said at least one vent is formed in said cylindrical portion.

12. A friction spinning roller according to claim 9, wherein said at least partly foraminous rotatable outer sleeve has a radially extending end wall, and said at least one said vent extends axially through said radially extending end wall.

13. A friction spinning roller according to claim 9, wherein the at least partly foraminous rotatable outer sleeve has a perforated major portion communicating internal suction with the friction spinning nip, and has an end wall portion of imperforate form, and wherein said at least one vent is formed in said imperforate end wall portion adjacent said air-transmitting bearing means and opens into the interior of said at least partly foraminous rotatable outer sleeve closer to the said perforated region than is the air-transmitting bearing means.

14. A friction spinning roller according to claim 10, including respective said air-tramsmitting bearing means and a respective said common labyrinth seal at each end of the at least partly foraminous rotatable outer sleeve, and a respective said at least one vent by-passing the respective air-transmitting bearing means at each end of the at least partly foraminous rotatable outer sleeve.

* * * * *